US010864974B2

(12) United States Patent
Stephanuik et al.

(10) Patent No.: US 10,864,974 B2
(45) Date of Patent: Dec. 15, 2020

(54) PROPELLER ASSEMBLY WITH HUB STRUCTURE WHICH REDUCES GEAR NOISE DURING OPERATION

(71) Applicant: Turning Point Propellers, Inc., Jacksonville, FL (US)

(72) Inventors: Phil Stephanuik, Jacksonville, FL (US); Liheng Chen, Jacksonville, FL (US); Ron Bailey, Jacksonville, FL (US)

(73) Assignee: Turning Point Propeilers, Inc., Jacksonville, FL (US)

( * ) Notice: Subject to any disclaimer, the term of this patent is extended or adjusted under 35 U.S.C. 154(b) by 156 days.

(21) Appl. No.: 16/052,196

(22) Filed: Aug. 1, 2018

(65) Prior Publication Data

US 2020/0039619 A1 Feb. 6, 2020

(51) Int. Cl.
*B63H 1/20* (2006.01)

(52) U.S. Cl.
CPC ..... *B63H 1/20* (2013.01)

(58) Field of Classification Search
CPC ..... B63H 1/20
See application file for complete search history.

(56) References Cited

U.S. PATENT DOCUMENTS 6,158,960 A * 12/2000 Marsi ..... B63H 3/008 416/43
6,609,892 B1 * 8/2003 Kreul ..... B63H 1/20 416/134 R
6,659,818 B2 * 12/2003 Booe ..... B63H 23/34 416/134 R
7,008,188 B2 3/2006 Booe, Jr.
7,223,073 B2 * 5/2007 Dean ..... B63H 1/20 416/134 R
7,708,526 B2 * 5/2010 Chen ..... B63H 23/34 416/134 R
7,717,678 B2 * 5/2010 Chen ..... B63H 1/14 416/134 R
8,277,269 B1 10/2012 Alby et al.
2002/0009367 A1 * 1/2002 Chen ..... B63H 23/34 416/134 R
2002/0085914 A1 * 7/2002 Chen ..... B63H 1/20 416/134 R
2003/0118443 A1 * 6/2003 Chen ..... B63H 23/34 416/2

(Continued)

*Primary Examiner* — Aaron R Eastman
*Assistant Examiner* — Theodore C Ribadeneyra
(74) *Attorney, Agent, or Firm* — Boyle Fredrickson, S.C.

(57) ABSTRACT

A propeller assembly is provided for mounting on a rotatable propeller shaft of a watercraft. The propeller assembly includes a hub structure having a plurality of circumferentially spaced blades projecting therefrom and an inner surface defining a passage. An adaptor is receivable in the passage of the hub structure. The adaptor a plurality of key pairs extending along the outer surface thereof the adaptor which define slots for receiving inserts therein. An inner portion of the first side of each insert forms mating relationship with first portion of the first sidewall of a first key of a corresponding key pair and an inner portion of the second side of the insert forms a mating relationship with the first portion of the second sidewall of a second key of the corresponding key pair with the insert received in the corresponding slot.

26 Claims, 4 Drawing Sheets

(56) References Cited

U.S. PATENT DOCUMENTS

| | | | | |
|---|---|---|---|---|
| 2005/0186861 | A1 | 8/2005 | Powers | |
| 2006/0263219 | A1* | 11/2006 | Dean | B63H 1/20 416/134 R |
| 2008/0139061 | A1* | 6/2008 | Chen | B63H 1/14 440/78 |
| 2009/0075535 | A1 | 3/2009 | Lin et al. | |
| 2009/0163089 | A1* | 6/2009 | Chen | B63H 23/34 440/49 |
| 2014/0205455 | A1 | 7/2014 | Kuroki | |
| 2015/0336647 | A1* | 11/2015 | Ariga | B63H 1/15 416/146 R |
| 2018/0105246 | A1* | 4/2018 | Kray | F01D 5/30 |

* cited by examiner

PROPELLER ASSEMBLY WITH HUB STRUCTURE WHICH REDUCES GEAR NOISE DURING OPERATION

FIELD OF THE INVENTION

This invention relates to marine propellers, and in particular, to a propeller assembly having a hub structure which translates rotational movement from a propeller shaft of a marine vehicle to the blades of a propeller and which limits the gear noise associated with operation of an engine of the marine vehicle operatively connected to the propeller assembly at low revolutions per minute (rpm).

BACKGROUND AND SUMMARY OF THE INVENTION

It is known to propel a marine vehicle utilizing a propeller assembly mounted on a rotatable shaft. The propeller assembly includes propeller blades extending from a central hub. A motor rotates the drive shaft which, in turn, rotates the central hub and the propeller blades. A hub assembly is provided to interconnect the central hub to the drive shaft. As is known, rotation of the propeller blades extending from the central hub propels the marine vehicle through the water.

Typically, the propeller assembly is constructed as a unit wherein the propeller blades, the central hub and the hub assembly are mounted or removed from the drive shaft in unison. Typically, the central hub of the propeller assembly includes an outer cylindrical housing which is welded or otherwise attached to a plurality of propeller blades. The central hub also includes an inner cylindrical housing which is co-axial with the outer cylindrical housing and radially spaced therefrom. The inner housing is supported within the outer housing by a plurality of circumferentially spaced ribs. The propeller assembly further includes a hub assembly disposed within the inner cylindrical housing of the propeller hub assembly. The hub assembly includes a drive member having an inner surface which meshes with splines on the outer surface of the drive shaft and an outer surface. A bushing formed from a rubber or elastomeric material is provided between the inner surface of the inner housing and the outer surface of the drive member. The elastomeric bushing provides shock absorbency between the propeller hub assembly and the drive shaft.

As is known, the drive shafts driven by the various motors for marine vehicles differ depending upon the manufacture. Consequently, individual propeller assemblies must be provided for the drive shafts of each motor brand. Maintaining an inventory of specific propellers for each brand of motor requires significant storage space and may be cost prohibitive. As such, in order to reduce the time and costs associated with replacing the propeller blades, it has been contemplated to provide a propeller assembly for a marine engine wherein the propeller blades project from a propeller housing that is removable from a central hub. By way of example, Chen, U.S. Pat. No. 7,717,678 discloses a propeller assembly for mounting on a propeller shaft of a watercraft. The propeller assembly includes a housing structure having a plurality of blades projecting radially therefrom. A bushing assembly translates rotational movement of the propeller shaft to the housing structure. The bushing assembly includes a spindle having an inner surface that meshes with the outer surface of a propeller shaft and a resilient bushing molded over the spindle. A plurality of spaced, longitudinally extending keys extend along the outer surface of the spindle. In the event that the propeller blades become fixed during operation of the watercraft, the keys fragment from the outer surface of spindle so as to disengage the spindle from the housing structure. In such manner, damage to the engine and to the drive system of the marine vehicle may be avoided.

While the advantages of a removable propeller housing are readily apparent, it can be appreciated that these types of propeller assemblies must be retained on the propeller shaft in such a manner as to prevent any unnecessary movement of the propeller assembly that may reduce the overall efficiency of the drive system of the marine vehicle and to limit gear noise when the marine engine is operated at low revolutions per minute (rpm).

Therefore, it is a primary object and feature of the present invention to provide a propeller assembly having a hub structure which discourages any unnecessary movement of the propeller assembly during operation.

It is a still further object and feature of the present invention to provide a propeller assembly having a hub structure which limits gear noise when the marine engine operatively connected to the propeller assembly is operated at low revolutions per minute (rpm).

It is a still further object and feature of the present invention to provide a propeller assembly having a hub structure which may be easily adapted for mounting propellers on the drive shafts of different manufacturers' motors.

It is a still further object and feature of the present invention to provide a propeller assembly having a hub structure which is simple and inexpensive to manufacture.

In accordance with the present invention, a connection assembly is provided for interconnecting a propeller shaft to a central hub of a propeller, the central hub extending along a longitudinal axis and including an inner surface. The connection assembly includes an adaptor having an inner surface defining a passageway for receiving the propeller shaft therethrough and an outer surface having first and second longitudinally extending keys extending therealong and defining a slot therebetween. Each key is defined by first and second sidewalls having first portions that diverge from each other. An insert having first and second sides is slideably receivable in the slot. The first and second sides of the insert include inner portions. The inner portion of the first side of the insert forms a mating relationship with the first portion of the first sidewall of the first key and the inner portion of the second side of the insert forms a mating relationship with the first portion of the second sidewall of the second key with the insert received in the slot.

The inner surface of the adaptor includes a plurality of splines for forming a mating relationship with the propeller shaft. The adaptor also includes an enlarged head extending radially from a first end thereof. The enlarged head is engageable with the central hub. A locking nut is mountable on the propeller shaft for retaining the adaptor and the insert thereon and a washer disposed on the propeller shaft adjacent the locking nut.

The insert is formed from a resilient material and has a generally arcuate inner surface engageable with the outer surface of the adaptor with the insert received in the slot. The first and second sidewalls of each of the first and second keys includes second portions extending from terminal ends of the first portions of the first and second sidewalls and converging toward each other. Each of the first and second keys has a generally arcuate outer surface extending between terminal ends of the second portions of the first and second sidewalls of the keys.

Each of the first and second sides of the insert includes an outer portion extending from terminal ends of the inner portions of the first and second sides and diverging from each other. The outer portion of the first side of the insert forms a mating relationship with the second portion of the first sidewall of the first key and the outer portion of the second side of the insert forms a mating relationship with the second portion of the second sidewall of the second key with the insert received in the slot. The insert has an outer surface extending between terminal ends of the terminal ends of the outer portions of the first and second sidewalls of the insert. The outer surface includes a generally planar portion.

In accordance with a further aspect of the present invention, a connection assembly is provided for interconnecting a propeller shaft to a central hub of a propeller. The central hub extends along a longitudinal axis and includes an inner surface. The connection assembly includes an adaptor having an inner surface defining a passageway for receiving the propeller shaft therethrough and an outer surface. A plurality of longitudinally extending key pairs extend along the outer surface of the adaptor. Each key pair defines a slot and each key of each key pair is defined by first and second sidewalls having first portions that diverge from each other. The connection assembly further includes a plurality of inserts. Each insert is receivable in a corresponding slot and has first and second sides. The first and second sides of each insert include inner portions. The inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot.

The inner surface of the adaptor includes a plurality of splines for forming a mating relationship with the propeller shaft. The adaptor includes an enlarged head extending radially from a first end thereof. The enlarged head is engageable with the central hub. A locking nut is mountable on the propeller shaft for retaining the adaptor and the insert thereon and a washer may be disposed on the propeller shaft adjacent the locking nut.

Each insert is formed from a resilient material and has a generally arcuate inner surface engageable with the outer surface of the adaptor with the insert received in the corresponding slot. The first and second sidewalls of the first and second keys of each key pair include second portions extending from terminal ends of the first portions of the first and second sidewalls and converging toward each other. The first and second keys of each key pair have a generally arcuate outer surface extending between terminal ends of the second portions of the first and second sidewalls of the first and second keys of each key pair. The first and second sides of each insert includes an outer portion extending from terminal ends of the inner portions of the first and second sides and diverging from each other. The outer portion of the first side of each insert forms a mating relationship with the second portion of the first sidewall of the first key of each key pair and the outer portion of the second side of each insert forms a mating relationship with the second portion of the second sidewall of the second key of each key pair with the insert received in the corresponding slot. Each insert has an outer surface extending between terminal ends of the outer portions of the first and second sides of the insert. The outer surface includes a generally planar portion.

In accordance with a still further aspect of the present invention, a propeller assembly is provided for mounting on a rotatable propeller shaft of a watercraft. The propeller assembly includes a hub structure extending along a longitudinal axis. The hub structure includes an outer surface having a plurality of circumferentially spaced blades projecting therefrom and an inner surface defining a passage. An adaptor is receivable in the passage of the hub structure. The adaptor includes an inner surface defining a passageway for receiving the propeller shaft therethrough and an outer surface. A plurality of longitudinally extending key pairs extend along the outer surface of the adaptor. Each key pair defines a slot and each key of each key pair is defined by first and second sidewalls having first portions that diverge from each other. The propeller assembly includes a plurality of inserts. Each insert is receivable in a corresponding slot and has first and second sides. The first and second sides of each insert include inner portions. The inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot.

Each insert has a generally arcuate inner surface engageable with the outer surface of the adaptor with the insert received in the corresponding slot. The first and second sidewalls of the first and second keys of each key pair includes second portions extending from terminal ends of the first portions of the first and second sidewalls and converging toward each other. The first and second keys of each key pair have a generally arcuate outer surface extending between terminal ends of the second portions of the first and second sidewalls of the first and second keys of each key pair. The first and second sides of each insert include an outer portion extending from terminal ends of the inner portions of the first and second sides and diverging from each other. The outer portion of the first side of each insert forms a mating relationship with the second portion of the first sidewall of the first key of each key pair and the outer portion of the second side of each insert forms a mating relationship with the second portion of the second sidewall of the second key of each key pair with the insert received in the corresponding slot. The insert has an outer surface extending between terminal ends of the outer portions of the first and second sides of the insert. The outer surface includes a generally planar portion.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
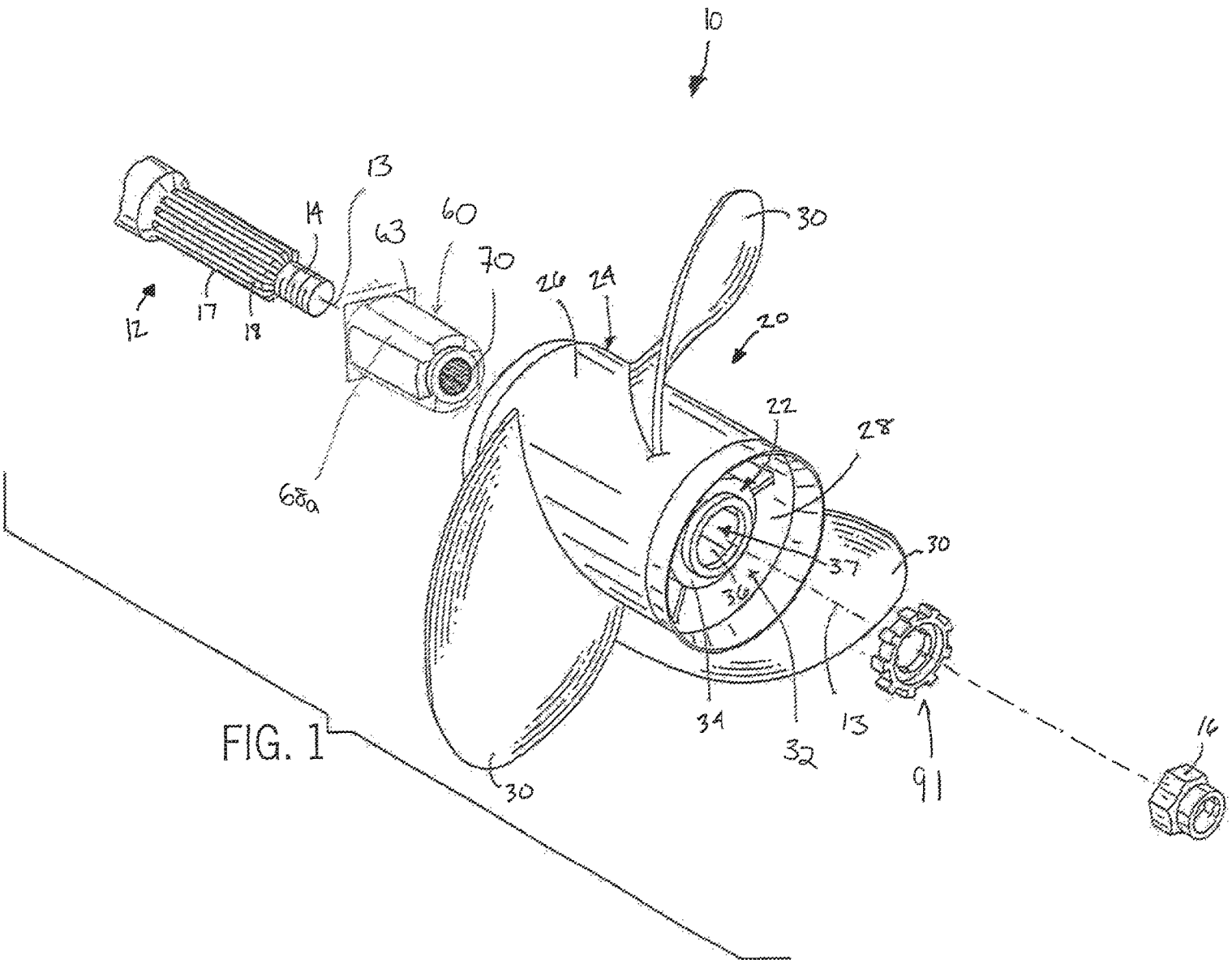
FIG. 1 is an exploded, isometric view of a propeller assembly in accordance with the present invention.

Referring to FIG. 1, a propeller assembly in accordance with the present invention is generally designated by the reference numeral 10. It is intended for propeller assembly 10 be mounted on a rotatable propeller shaft 12 which, in turn, is driven by a marine engine (not shown). Propeller shaft 12 extends along longitudinal axis 13 and terminates at a threaded terminal end 14 adapted for receiving a locking nut 16 thereon, for reasons hereinafter described. As is conventional, rotatable shaft 12 includes an outer surface 17 having longitudinally extending splines 18 therealong adjacent terminal end 14.

Figure 2:
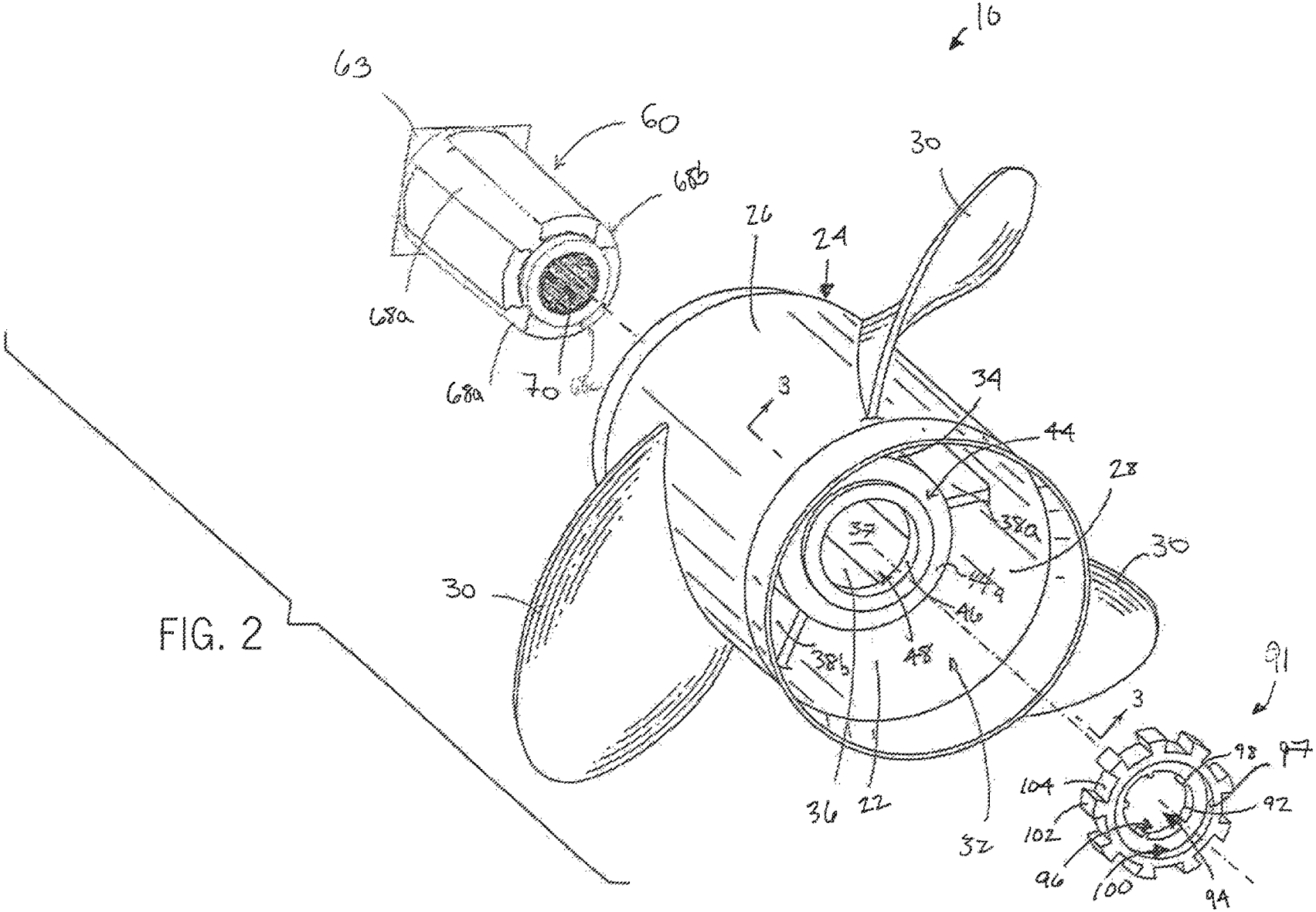
FIG. 2 is an enlarged, isometric view showing a portion of of the propeller assembly of FIG. 1.
Figure 3:
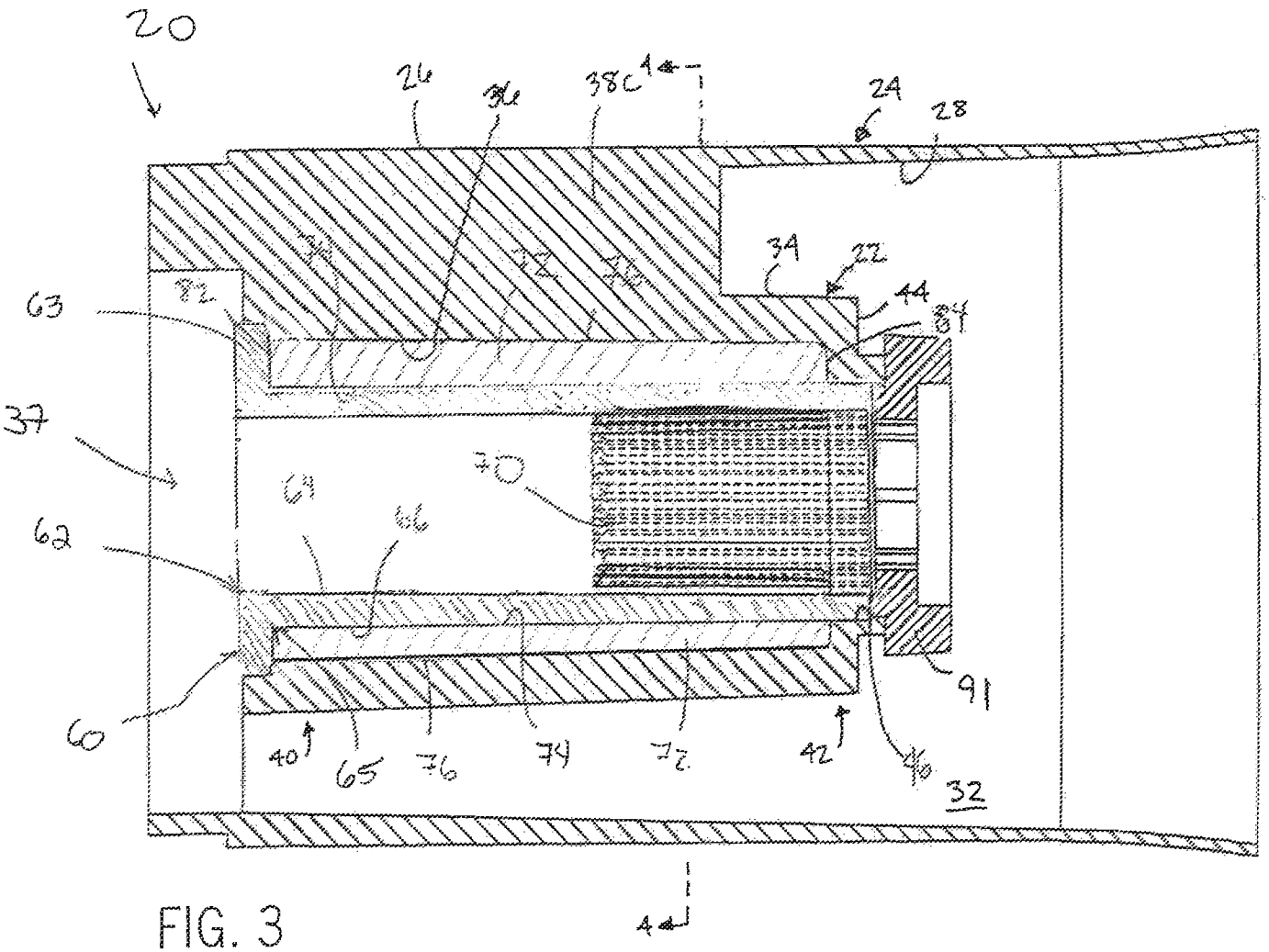
FIG. 3 is a cross-sectional view of the propeller assembly of the present invention taken along line 3-3 of FIG. 2.

Referring to FIGS. 1-3, propeller assembly 10 includes a central hub 20 having a generally cylindrical inner housing 22 and a generally cylindrical outer housing 24. Outer housing 24 has an outer surface 26 and an inner surface 28. A plurality of circumferentially spaced propeller blades 30 project radially from outer surface 26 of outer housing 24. Inner surface 28 defines an inner housing receipt cavity 32 for receiving inner housing 22 therein. Outer surface 34 of inner housing 22 and inner surface 28 of outer housing 24 are rigidly connected by a plurality of circumferentially spaced connection spokes 38*a*-38*c* extending therebetween. Spokes 38*a*-38*c* are circumferentially spaced about the outer surface 34 of inner housing 22.

Figure 4:
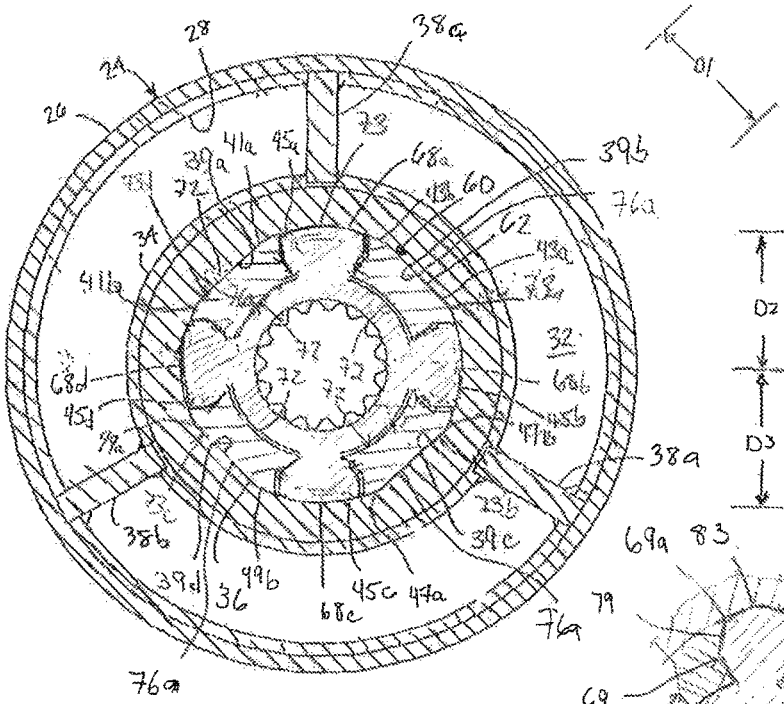
FIG. 4 is a cross-sectional view of the propeller assembly of the present invention taken along line 4-4 of FIG. 3 showing the propeller assembly during normal operating conditions.

Inner housing 22 of central hub 20 includes inner surface 36 that defines inner cavity 37 for receiving bushing assembly 60, as hereinafter described. Inner housing 22 further includes first and second opposite ends 40 and 42, respectively. End flange 44 projects radially inward from second end 42 of inner housing 22 and terminates at a radially inner surface 46 which defines generally circular opening 48. As best seen in FIG. 4, inner surface 36 of inner housing 22 is partially defined by first, second, third and fourth circumferentially spaced, longitudinally extending faces 39*a*-39*d*, respectively. First and third faces 39*a* and 39*c*, respectively, are generally parallel to and face each other. Similarly, second and fourth faces 39*b* and 39*d*, respectively, are generally parallel to and face each other. In addition, first and third faces 39*a* and 39*c*, respectively, are generally perpendicular to second and fourth faces 39*b* and 39*d*, respectively. Faces 39*a*-39*d* and longitudinal axis 13 are spaced by predetermined distances D1. It can be appreciated that as described, cavity 37 within inner housing 22 has a generally square cross-section. It is noted that while inner housing 22 has a generally square-shaped cross-section in the depicted embodiment, inner housing 22 may have other polygonal-shaped cross-sections without deviating from the scope of the present invention.

First side 41*a* of first face 39*a* is interconnect to second side 43*b* of second face 39*b* by a generally arcuate, longitudinally extending first corner 45*a*. First side 43*a* of second face 39*b* is interconnect to second side 47*b* of third face 39*c* by a generally arcuate, longitudinally extending second corner 45*b*. First side 47*a* of third face 39*c* is interconnect to second side 49*b* of fourth face 39*d* by a generally arcuate, longitudinally extending third corner 45*c*. First side 49*a* of fourth face 39*d* is interconnect to second side 41*b* of first face 39 a by a generally arcuate, longitudinally extending fourth corner 45*d*. For reasons hereinafter described, it can be appreciated the inner surfaces 51*a*-51*d*, of corners 45*a*-45*d*, respectively, are a predetermined distance D2 from longitudinal axis 13.

Figure 5:
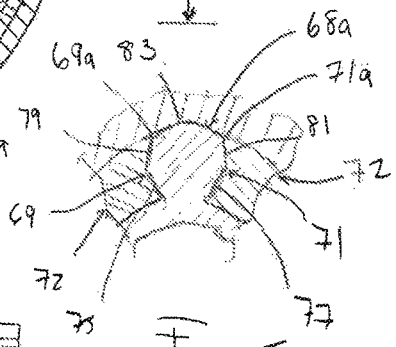
FIG. 5 is an enlarged view showing a portion of the propeller assembly of FIG. 4.

Propeller assembly 10 further includes bushing assembly 60 which is intended to translate rotation of propeller shaft 12 to central hub 20. Bushing assembly 60 includes spindle 62 having an inner surface 64 and a generally cylindrical outer surface 66. Plate 63 extends radially from first end 65 of spindle 62, for reasons hereinafter described. In the depicted embodiment, plate 63 has a generally square configuration. However, other configurations are contemplated as being within the scope of the present invention. Inner surface 64 of spindle 62 includes a plurality of longitudinally extending splines 70 extending therealong which are intended to mesh with splines 18 extending along propeller shaft 12 when bushing assembly 60 is mounted thereon. A plurality of circumferentially spaced, longitudinally extending keys 68*a*-68*d* project radially from outer surface 66 of spindle 62. Each key 68*a*-68*d* is defined by first and second sides 69 and 71, respectively, which extend from outer surface 66 and terminal end 59 opposite plate 63. Sides 69 and 71 of each key 68*a*-68*d* include inner portions 75 and 77, respectively, extending radially from outer surface 66 and diverging from each other, FIG. 5. Outer portions 79 and 81 of sides 69 and 71, respectively, of each key 68*a*-68*d* extend radially from inner portions 75 and 77, respectively, of sides 69 and 71 and are generally parallel to each other.

Radially outer ends 69*a* and 71*a* of first and second sides 69 and 71, respectively, of keys 68*a*-68*d* are interconnected by generally arcuate end surface 83. End surfaces 83 of keys 68*a*-68*d* are radially spaced from longitudinal axis 13 by a predetermined distance D3. For reasons hereafter described, distance D3 is greater than distance D1 and less than distance D2. It is contemplated for keys 68*a*-68*d* to be frangible such that keys 68*a*-68*d* disengage from outer surface 66 of spindle 62 in response to a predetermined force thereon. As described, second side 71 of first key 68*a* is spaced from first side 69 of second key 68*b* by a first slot 73*a*; second side 71 of second key 68*b* is spaced from first side 69 of third key 68*c* by a second slot 73*b*; second side 71 of third key 68*b* is spaced from first side 69 of fourth key 68*d* by a third slot 73*c*; and second side 71 of fourth key 68*d* is spaced from first side 69 of first key 68*a* by a fourth slot 73*d*.

Bushing assembly 60 further includes a plurality of inserts 72 adapted for insertion into corresponding slots 73*a*-73*d* about outer surface 66 of spindle 62. It is contemplated for each of the inserts 72 to be identical in structure and fabricated from any one of various resilient natural or synthetic materials which normally retain their molded shape, permit some flexing and distortion under shear, and resume their molded shape after the stress is removed. Each insert 72 includes a generally arcuate inner surface 74 which corresponds in shape to outer surface 66 of spindle 62 and a generally arcuate outer surface 76 adapted to engage a corresponding face 39*a*-39*d* along inner surface 36 of inner housing 22, as hereinafter described.

Figure 6:
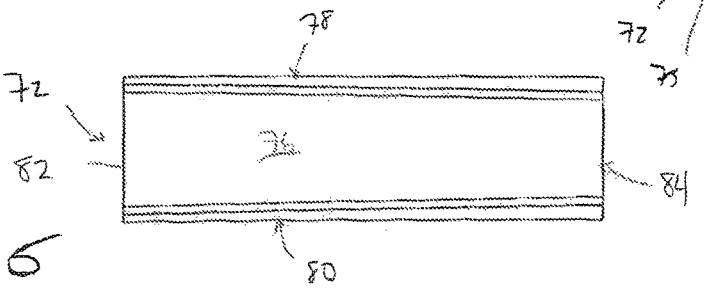
FIG. 6 is top plan view of an insert receivable in a hub structure of the propeller assembly of the present invention.
Figure 7:
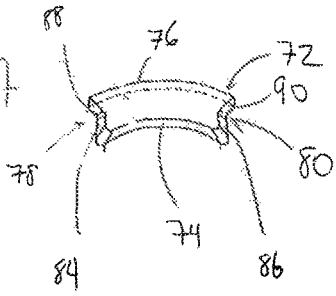
FIG. 7 is an end view of a first end of the insert of FIG. 5.
Figure 8:
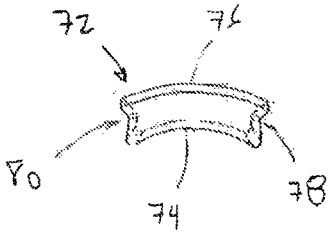
FIG. 8 is an end view of a second end of the insert of FIG. 5.

Inner and outer surfaces 74 and 76, respectively, of each insert 72 are interconnected by first and second sides 78 and 80, respectively and first and second ends 82 and 84, respectively. As best seen in FIG. 6, sides 78 and 80 may be tapered to facilitate the siding of inserts 72 into corresponding slots 73*a*-73*d*. Sides 78 and 80 of each insert 72 include first portions 84 and 86, respectively, that extend from inner surface 74 of each insert 72 and that may converge slightly to facilitate the forming of a mating relationship with inner portions 75 and 77 of sides 69 and 71, respectively, of each key 68*a*-68*d* with inserts 72 received in slots 73*a*-73*d*. Sides 78 and 80 of each insert 72 further include second portions 88 and 90, respectively, that extend from first portions 84 and 86, respectively, of sides 78 and 80 and that diverge to facilitate the forming of a mating relationship with inner portions outer portions 79 and 81, respectively, of sides 69 and 71, respectively, of each key 68*a*-68*d* with inserts 72 received in slots 73*a*-73*d*.

Referring back to FIGS. 1-3, in order to assemble a propeller assembly 10, inserts 72 are slid axially into corresponding slots 73*a*-73*d* such that first portions 84 and 86 of sides 78 and 80, respectively, of each insert 72 slideably engage and form a mating relationship with inner portions 75 and 77 of sides 69 and 71, respectively, of corresponding keys 68*a*-68*d* and such that second portions 88 and 90 of sides 78 and 80, respectively, of each insert 72 slideably engage and form mating relationships with outer portions 79 and 81, respectively, of sides 69 and 71, respectively, of each key 68*a*-68*d*. Inserts 72 are received in slots 73*a*-73*a* such that first ends 80 of inserts 72 engage plate 63 of spindle 62 and such that second ends 82 of inserts 72 are substantially flush with terminal ends 59 of keys 68*a*-68*d*.

It can be understood that the resiliency of inserts 32 provides shock absorbency between propeller assembly 10 and propeller shaft 12 and prevents any unnecessary movement of propeller assembly 10 during operation. As such, propeller assembly 10 incorporating inserts 32 increases the overall efficiency of the drive system of the marine vehicle. Further, by eliminating any unnecessary movement of propeller assembly 10 during operation, inserts 32 eliminate the rattle noise associated with the shifting of the gears of the marine engine when the marine engine is operated at low revolutions per minute (rpm). In addition, it can be further appreciated that due to the simplicity associated with installing inserts 32 on spindle 62, a user may easily replace inserts 32 on spindle 62 when the material from which inserts 32 were fabricated becomes fatigued.

With inserts 72 received on spindle 62, bushing assembly 60 is inserted within inner cavity 37 of inner housing 22 such that outer surfaces 76 of inserts 32 engage and are compressed by corresponding faces 39*a*-39*d* of inner surface 36 of inner housing 22, end surfaces 83 of keys 68*a*-68*d* engage corresponding inner surfaces 51*a*-51*d* of corners 45*a*-45*d*, respectively, of inner housing 22, and second ends 82 of inserts 72, as well as, terminal ends 59 of keys 68*a*-68*d* abut end flange 44 of inner housing 22. Outer surfaces 76 of inserts 72 are compressed by corresponding faces 39*a*-39*d* of inner surface 36 of inner housing 22 such that portions 76*a* of outer surfaces 76 of inserts become generally planar and form mating relationships with corresponding faces 39*a*-39*d* of inner surface 36 of inner housing 22.

In order to mount the propeller assembly 10 on propeller shaft 12, terminal end 14 of propeller shaft 12 is axially inserted through bushing assembly 60 such that splines 18 on outer surface 17 of propeller shaft 12 mesh with splines 70 along inner surface 64 of spindle 62 and such that terminal end 14 of propeller shaft 12 extends through the opening 48 defined by flange 44 of inner housing 22. Spider washer 91 is positioned on terminal end 14 of propeller shaft 12 adjacent outer surface 44*a* of flange 44 of inner housing. Spider washer 91 includes an inner surface 92 defining a passageway 94 therethrough. Longitudinally extending splines 98 extend along a first portion 96 of inner surface 92 of spider washer 90 and are adapted to mesh with splines 18 of propeller shaft 12. Inner surface 92 of spider washer 90 further includes a second portion 97 defining an enlarged portion 100 of passageway 94. Enlarged portion 100 of passageway 94 is of sufficient dimension to receive locking nut 16 threaded on terminal end 14 of propeller shaft 12 therein. It is contemplated for a plurality of circumferentially spaced tabs 102 to extend from outer surface 104 of spider washer 90. Tabs 102 are adapted for receiving a tab washer (not shown) which may be provided by selected OEM manufacturers of marine drive equipment in order to help maintain propeller assembly 10 on drive shaft 12.

As is conventional, meshed splines 18 and 70 of propeller shaft 12 and spindle 62, respectively, translate rotation of propeller shaft 12 to central hub 20 through bushing assembly 60. During operation of a marine vehicle in a body of water, rotation of propeller shaft 12 is translated to propeller assembly 10 such that propeller blades 30 propel the marine vehicle through the body of water. In the event that propeller blades 30 become fixed due to engagement with an object in the water, it can be appreciated that the engine of the marine vehicle will continue to attempt to rotate propeller shaft 12. As a result, rotational forces will be exerted on keys 68*a*-68*d* projecting from outer surface 66 of spindle 62 by the propeller shaft 12. If the forces on keys 68*a*-68*d* exceed a predetermined threshold, one or more of keys 68*a*-68*d* will compress inserts 72 therebetween causing spindle 62 to rotate within inner cavity 37 of inner housing 22. If propeller assembly 10 remains fixed by the object in the body of water, the rotational forces generated by propeller shaft 12 on bushing assembly 60 will urge keys 68*a*-68*d* into engagement with corresponding second sides 41*b*, 43*b*, 47*b* and 49*b* of corresponding faces 39*a*-39*d* of inner surface 36 of inner housing 22 since end surfaces 73 of keys 68*a*-68*d* are a greater radial distance D3 from longitudinal axis 13 than the distance D1 that faces 39*a*-39*d* are from longitudinal axis 13, thereby allowing rotation of propeller shaft 12 to be translated to propeller assembly 10 once propeller blades 30 become disengaged from the object.

Various modes of carrying out the invention are contemplated as being within the scope of the following claims particularly pointing out and distinctly claiming the subject matter which is regarded as the invention.

We claim:

1. A connection assembly for interconnecting a propeller shaft to a central hub of a propeller, the central hub extending along a longitudinal axis and including an inner surface, comprising:

an adaptor having an inner surface defining a passageway for receiving the propeller shaft therethrough and an outer surface having first and second longitudinally extending keys extending therealong and defining a slot therebetween having a first open end and a second closed end, each key defined by first and second sidewalls having first portions that diverge from each other; and an insert having an inner surface and an outer surface interconnected by first and second ends and first and second sides, the insert being slideably receivable in the slot such that the insert extends between the open end and the closed end of the slot;

wherein:

the first and second sides of the insert including inner portions; and the inner portion of the first side of the insert forms a mating relationship with the first portion of the first sidewall of the first key and the inner portion of the second side of the insert forms a mating relationship with the first portion of the second sidewall of the second key with the insert received in the slot.

2. The connection assembly of claim 1 wherein the inner surface of the adaptor includes a plurality of splines for forming a mating relationship with the propeller shaft.

3. The connection assembly of claim 1 wherein the insert is formed from a resilient material.

4. The connection assembly of claim 1 wherein the adaptor includes an enlarged head extending radially from a first end thereof, the enlarged head engageable with the central hub.

5. The connection assembly of claim 1 further comprising a locking nut mountable on the propeller shaft for retaining the adaptor and the insert thereon and a washer disposed on the propeller shaft adjacent the locking nut.

6. The connection assembly of claim 1 wherein the insert has a generally arcuate inner surface engageable with the outer surface of the adaptor with the insert received in the slot.

7. A connection assembly for interconnecting a propeller shaft to a central hub of a propeller, the central hub extending along a longitudinal axis and including an inner surface, comprising:

an adaptor having an inner surface defining a passageway for receiving the propeller shaft therethrough and an outer surface having first and second longitudinally extending keys extending therealong and defining a slot therebetween, each key defined by first and second sidewalls having first portions that diverge from each other; and an insert having first and second sides and being slideably receivable in the slot, the first and second sides of the insert including inner portions;

wherein the inner portion of the first side of the insert forms a mating relationship with the first portion of the first sidewall of the first key and the inner portion of the second side of the insert forms a mating relationship with the first portion of the second sidewall of the second key with the insert received in the slot; wherein the first and second sidewalls of each of the first and second keys includes second portions extending from terminal ends of the first portions of the first and second sidewalls and converging toward each other.

8. The connection assembly of claim 7 wherein each of the first and second keys has a generally arcuate outer surface extending between terminal ends of the second portions of the first and second sidewalls of the keys.

9. The connection assembly of claim 8 wherein each of the first and second sides of the insert includes an outer portion extending from terminal ends of the inner portions of the first and second sides and diverging from each other, the outer portion of the first side of the insert forms a mating relationship with the second portion of the first sidewall of the first key and the outer portion of the second side of the insert forms a mating relationship with the second portion of the second sidewall of the second key with the insert received in the slot.

10. The connection assembly of claim 9 wherein the insert has an outer surface extending between terminal ends of the terminal ends of the outer portions of the first and second sidewalls of the insert, the outer surface including a generally planar portion.

11. A connection assembly for interconnecting a propeller shaft to a central hub of a propeller, the central hub extending along a longitudinal axis and including an inner surface, comprising:

an adaptor having an inner surface defining a passageway for receiving the propeller shaft therethrough and an outer surface;

a plurality of longitudinally extending key pairs extending along the outer surface of the adaptor, each key pair defining a slot having a first open end and a second closed end and each key of each key pair being defined by first and second sidewalls having first portions that diverge from each other; and a plurality of inserts, each insert being receivable in a corresponding slot such that the insert extends between the open end and the closed end of the slot and having an inner surface and an outer surface interconnected by first and second ends and first and second sides;

wherein:

the first and second sides of each insert including inner portions; and the inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot.

12. The connection assembly of claim 11 wherein the inner surface of the adaptor includes a plurality of splines for forming a mating relationship with the propeller shaft.

13. The connection assembly of claim 11 wherein the insert is formed from a resilient material.

14. The connection assembly of claim 11 wherein the adaptor includes an enlarged head extending radially from a first end thereof, the enlarged head engageable with the central hub.

15. The connection assembly of claim 11 further comprising a locking nut mountable on the propeller shaft for retaining the adaptor and the insert thereon and a washer disposed on the propeller shaft adjacent the locking nut.

16. The connection assembly of claim 11 wherein each insert has a generally arcuate inner surface engageable with the outer surface of the adaptor with the insert received in the corresponding slot.

17. A connection assembly for interconnecting a propeller shaft to a central hub of a propeller, the central hub extending along a longitudinal axis and including an inner surface, comprising:

an adaptor having an inner surface defining a passageway for receiving the propeller shaft therethrough and an outer surface;

a plurality of longitudinally extending key pairs extending along the outer surface of the adaptor, each key pair defining a slot and each key of each key pair being defined by first and second sidewalls having first portions that diverge from each other; and a plurality of inserts, each insert being receivable in a corresponding slot and having first and second sides, the first and second sides of each insert including inner portions;

wherein the inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot;

wherein the first and second sidewalls of the first and second keys of each key pair include second portions extending from terminal ends of the first portions of the first and second sidewalls and converging toward each other.

18. The connection assembly of claim 17 wherein the first and second keys of each key pair have a generally arcuate outer surface extending between terminal ends of the second portions of the first and second sidewalls of the first and second keys of each key pair.

19. The connection assembly of claim 18 wherein the first and second sides of each insert includes an outer portion extending from terminal ends of the inner portions of the first and second sides and diverging from each other, the outer portion of the first side of each insert forms a mating relationship with the second portion of the first sidewall of the first key of each key pair and the outer portion of the second side of each insert forms a mating relationship with the second portion of the second sidewall of the second key of each key pair with the insert received in the corresponding slot.

20. The connection assembly of claim 19 wherein each insert has an outer surface extending between terminal ends of the outer portions of the first and second sides of the insert, the outer surface including a generally planar portion.

21. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface defining a passage;

an adaptor receivable in the passage of the hub structure, the adaptor including an inner surface defining a passageway for receiving the propeller shaft therethrough and an outer surface;

a plurality of longitudinally extending key pairs extending along the outer surface of the adaptor, each key pair defining a slot having a first open end and a second closed end and each key of each key pair being defined by first and second sidewalls having first portions that diverge from each other; and a plurality of inserts, each insert being receivable in a corresponding slot such that the insert extends between the open end and the closed end of the slot and having an inner surface and an outer surface interconnected by first and second ends and first and second sides;

wherein:

the first and second sides of each insert including inner portions; and the inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot.

22. The propeller assembly of claim 21 wherein each insert has a generally arcuate inner surface engageable with the outer surface of the adaptor with the insert received in the corresponding slot.

23. A propeller assembly for mounting on a rotatable propeller shaft of a watercraft, comprising:

a hub structure extending along a longitudinal axis, the hub structure including an outer surface having a plurality of circumferentially spaced blades projecting therefrom and an inner surface defining a passage;

an adaptor receivable in the passage of the hub structure, the adaptor including an inner surface defining a passageway for receiving the propeller shaft therethrough and an outer surface;

a plurality of longitudinally extending key pairs extending along the outer surface of the adaptor, each key pair defining a slot and each key of each key pair being defined by first and second sidewalls having first portions that diverge from each other; and a plurality of inserts, each insert being receivable in a corresponding slot and having first and second sides, the first and second sides of each insert including inner portions;

wherein the inner portion of the first side of each insert forms a mating relationship with the first portion of the first sidewall of a first key of a corresponding key pair and the inner portion of the second side of the insert forms a mating relationship with the first portion of the second sidewall of a second key of the corresponding key pair with the insert received in the corresponding slot;

wherein the first and second sidewalls of the first and second keys of each key pair include second portions extending from terminal ends of the first portions of the first and second sidewalls and converging toward each other.

24. The propeller assembly of claim 23 wherein the first and second keys of each key pair have a generally arcuate outer surface extending between terminal ends of the second portions of the first and second sidewalls of the first and second keys of each key pair.

25. The propeller assembly of claim 24 wherein the first and second sides of each insert includes an outer portion extending from terminal ends of the inner portions of the first and second sides and diverging from each other, the outer portion of the first side of each insert forms a mating relationship with the second portion of the first sidewall of the first key of each key pair and the outer portion of the second side of each insert forms a mating relationship with the second portion of the second sidewall of the second key of each key pair with the insert received in the corresponding slot.

26. The propeller assembly of claim 23 wherein the insert has an outer surface extending between terminal ends of the outer portions of the first and second sides of the insert, the outer surface including a generally planar portion.

* * * * *